United States Patent [19]

Taylor

[11] Patent Number: 4,638,615

[45] Date of Patent: Jan. 27, 1987

[54] METALLIC STRUCTURAL MEMBER PARTICULARLY FOR SUPPORT OF WALLS AND FLOORS OF BUILDINGS

[76] Inventor: Lawrence H. Taylor, P.O. Box 49-58, 48th St. Station, Union City, N.J. 07087

[21] Appl. No.: 788,643

[22] Filed: Oct. 17, 1985

[51] Int. Cl.[4] ..... E04C 3/30

[52] U.S. Cl. ..... 52/364; 52/481; 52/720

[58] Field of Search ..... 52/481, 364, 377, 720, 52/633

[56] References Cited

U.S. PATENT DOCUMENTS

| | | | |
|---|---|---|---|
| 3,129,792 | 4/1964 | Gwynne | 52/364 |
| 3,270,472 | 9/1966 | Gilbert | 52/364 |
| 3,282,005 | 11/1966 | Birdwell | 52/364 |
| 3,956,998 | 5/1976 | Bavetz | 52/481 |
| 4,506,481 | 3/1985 | Witschi | 52/364 |
| 4,513,551 | 4/1985 | Gauffin | 52/364 |

FOREIGN PATENT DOCUMENTS

| | | | |
|---|---|---|---|
| 625693 | 8/1961 | Canada | 52/364 |
| 1056897 | 2/1967 | United Kingdom | 52/364 |

OTHER PUBLICATIONS

FIG. 2 of U.S. Pat. No. 3,956,998 Enlarged to Scale of 10.16 cm.

*Primary Examiner*—Henry E. Raduazo

*Attorney, Agent, or Firm*—Kerkam, Stowell, Kondracki & Clarke

[57] ABSTRACT

A structural metallic member particularly useful for framing interior and exterior walls, ceilings and floors of building structures consists of a hollow generally quadrangular in transverse cross-section stud consisting of at least three walls being provided with at least a pair of parallel, spaced, longitudinal rows of longitudinally spaced slits with abutting force. Each of the end walls of the three walls being provided with at least a row of longitudinally spaced slits spaced about ⅓ the width of the end walls adjacent the corner joined with the middle wall. In a form of studs where there are four contiguous walls, the slits are provided in the pair of opposed walls that will connect the inside and outside walls of the structure. The end wall would be provided with a pair of rows of slits adjacent each corner.

5 Claims, 4 Drawing Figures

METALLIC STRUCTURAL MEMBER PARTICULARLY FOR SUPPORT OF WALLS AND FLOORS OF BUILDINGS

BACKGROUND OF THE INVENTION

Steel structural members or studs in the form of c-beams and box 2×4's have been used for a number of years in construction work as framing for interior walls and for exterior walls which support, for example, plaster board and exterior sheathing. Such steel studs when used as structural members for exterior walls have a primary drawback in that they readily conduct exterior heat into the air-conditioned building in the summer and do the reverse in winter when the heat loss in cold weather can be so serious that the walls are discolored, called "shadowing", as moisture, including greasy dirt, is deposited on the colder parts of the wall in direct contact with the steel beams supporting the wall.

How serious is this heat loss, or gain, may be seen by considering that a small house of approximately 900 square feet and having dimensions of 32'×28' provided with studs 24" on center would have approximately 60 beams or studs about its perimeter. If each stud has dimensions of a 2"×4", with the 2" sides facing outside and inside there would be a total of steel exposed to the exterior surface. This is a very considerable area (over 8%) interior wall into the house or, in summer, radiating heat into the house.

It is known in the art to provide perforations and openings in metal structural members to receive nails, or to attach insulation, or to reduce heat transmission or a combination thereof and the following U.S. patents illustrate such metal structural members.

In many instances the open slit or punch out permits and in fact invites the passage of air in and out of the stud hollow center to the extent that this convection characteristic of the open slit or perforated opening is counter productive while costing substantially more in manufacturing the closed or abutting slit which can be done simultaneously with the roll slitting required in customary manufacturing of this product.

U.S. Pat. No. 4,016,700 Blomstedt
U.S. Pat. No. 3,841,047 Zinn
U.S. Pat. No. 3,525,189 Nelsson
U.S. Pat. No. 3,482,369 Burke
U.S. Pat. No. 3,158,236 Caligiuri
U.S. Pat. No. 3,129,792 Gwynne
U.S. Pat. No. 2,950,789 Davis Jr. et al
U.S. Pat. No. 1,997,876 Sheldon
U.S. Pat. No. 1,867,449 Ecket et al

BRIEF SUMMARY OF THE INVENTION

It is a primary object of the present ivention to provide metallic structural members or studs which are provided with two or three rows of longitudinally spaced slits in the side walls forming the major dimension of the studs perpendicular to the line of the house walls. A pair of rows of similarly formed slits is provided in each end of a box type stud, spaced about ⅓ the width of the end wall from each corner.

Where the structural member is of the c-beam type only a single row of slits is employed adjacent the corner contiguous with the side wall to the beam which can transmit sound or heat or cold to the other end wall. The reduced heat, cold or sound provides for a materially improved stud without substantially reducing the structural strength of such stud or materially increasing its cost.

In a particularly useful form of the invention the ratio of solid metal to slit longitudinally is 80% slit and 20% solid thus 80% of the transmission capability of the sheet is eliminated because almost no heat goes across the slit. In many applications the ratio of solid to slit can be increased to 10 to 1 with satisfactory retained strength.

The invention may be generally defined as a structural metallic member particularly useful for framing, interior and exterior walls, floors and ceilings (joists) of building structures consisting of a hollow, generally quadrangular, in transverse cross section, stud or joist having at least three contiguous walls with the middle of the at least three walls being provided with two or three parallel, spaced, longitudinaly rows of longitudinally spaced slits with, for example, one at ⅓ from each corner and one at about the center.

For example, using 3 lines of vertical 80% slit 20% solid and not using the end face slits the heat transmission capability of solid metal can be reduced to 20% by the first line of slits then the second line takes 80% of the first 20% reducing the net to 4% when a 3 slit line will reduce this transmission by 80% to 20% pass through or 0.8% or stopping the conduction capability by 99.2%.

Each of the end walls of the three walls being provided with a row of longitudinally spaced slits spaced about ⅓ the width of the end walls adjacent the corner which can transmit sound, or heat or cold to the opposite end wall to thereby reduce the area through which heat, cold, sound or fire threat can be transmitted.

BRIEF DESCRIPTION OF THE DRAWINGS

The invention will be more particularly described with reference to the accompanying drawing wherein.

Figure 1:
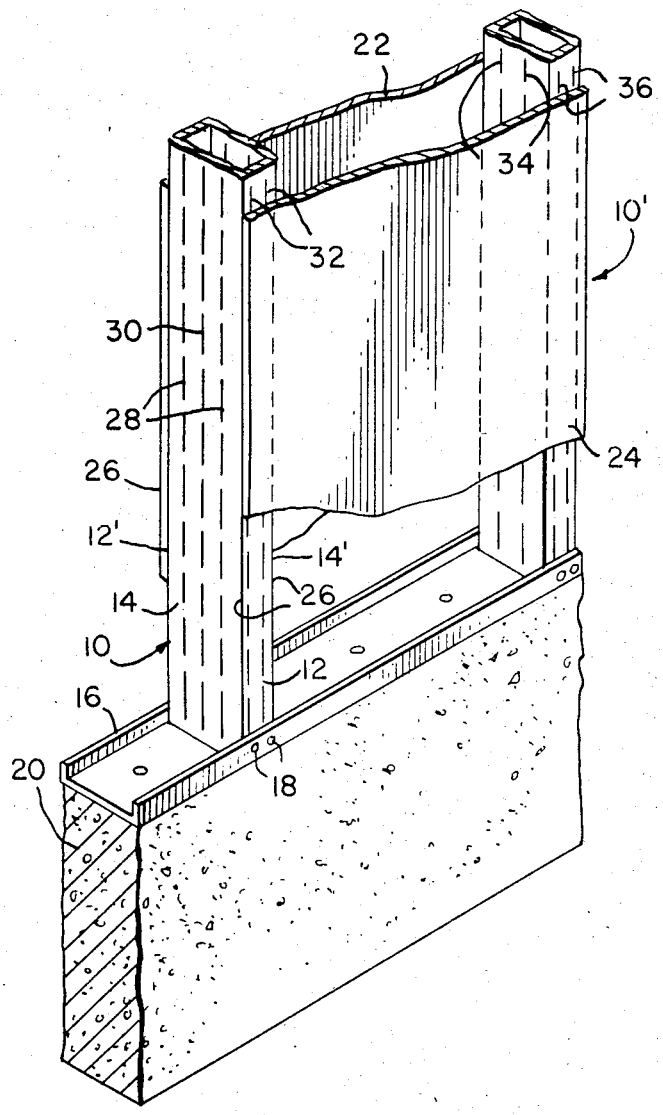
FIG. 1 is fragmentary, perspective view of box type studs contructed in accordance with the present invention supporting inside wall board and exterior sheathing.

Referring to the drawings and, in particular to FIGS. 1–3, 10 generally designates a hollow, metallic stud which by way of example has ends 12 and 12' having widths of about 2" and sides of about 4". It will be recognized that the invention is equally suited to studs or beams having other dimensions such as 2×6's, 2×8's, etc. The studs are illustrated in FIG. 1 held in a steel runner or plate 16 attached to a foundation wall 20 of a building.

The studs 10 support outside wall means 22 which may comprise the usual wall means in building construction. The studs 10 also support interially an inner wall 24 which may comprise conventional Gypsum or composite wallboard. Where the studs are for interior partitions each side of the panel would probably comprise Gypsum.

The stud 10 is formed from a sheet of, for example, 22 gauge steel which is provided with slits on its two wide faces. The slits are placed ⅓ the width of the particular face from the corners 26 as at 28 and with a third slit 30 midway between the corners 26. In the end faces 12 and 12' there are only two rows of slits 32 each ⅓ the width of the faces 12 or 12' from the corners 26.

In an example the slits are two inches long and ½ inch between slits thus there is 80% slit and 20% solid. This will reduce by 80% the transmission capabilities of the sheet progressively for each line of slits as shown above.

The slits 28 and 32 are placed ⅓ the width of the particular face from the corner as in metallic studs the greatest strength of the stud is in the zone of the corners.

The stud 10' FIG. 1 is provided with only two slits in the wide faces designated 34 and two slits on each of the narrow faces designated 36. Again these slits are spaced ⅓ the width of the particular face from the corners of the stud.

Figure 2:
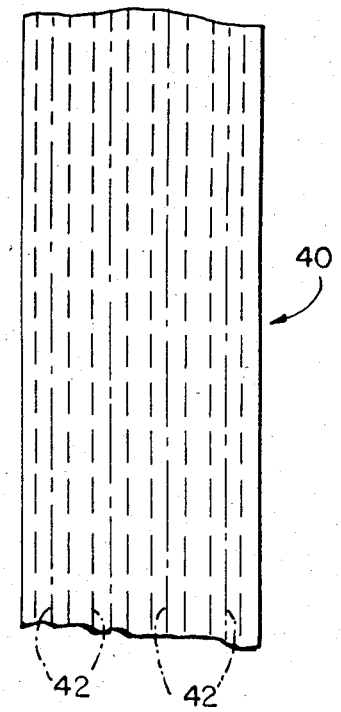
FIG. 2 is a plan view of a sheet of, for example, steel perforated or slitted in accordance with the teachings of the invention and ready to be folded into a box type stud.
Figure 3:
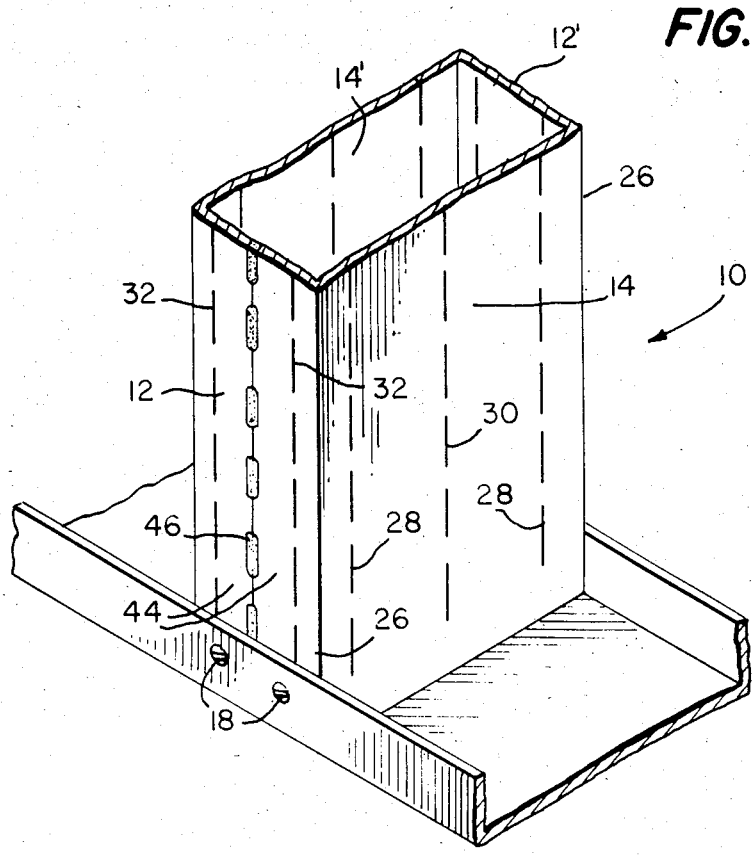
FIG. 3 is a fragmentary, perspective view of a box type beam formed from a panel such as shown in FIG. 2.

With the particular reference to FIG. 2 there is illustrated a sheet 40 which is slitted to provide the stud 10' when the sheet is folded on fold lines 42. After folding the edges of faces 44 and 44' are welded such as illustrated at 46.

The slits by way of example have a width of about a very thin knife edge such as, for example, 15,000th of an inch. Good results are obtained which the slits will pass light therethrough and will not pass water. Thus in order for the features of this invention to function slits with metal removed are not required.

The slits may be formed on conventional sheet metal slitting rolls as is known in the art without requiring a separate manufacturing step as the slitting work is done as the wide metal sheet is cut down to narrow strips for roll forming.

The slits should have abutting or substantially abutting faces which will not permit convection currents from transferring heat and cold between the end walls. It is recognized that where slits have substantial width that heat loss by convection currents may be greater than the reduction in heat transfer provided by the spaced slots.

It is particularly pointed out that applicant is the first to place slits in the end panels of metallic studs as the applicant has recognized that the beam strength of studs lies mainly in the corners and that the greatest heat absorption or radiation loss occurs at the end faces and reducing transmission of heat, cold or sound through the end faces is a primary feature of the present invention. Depending upon desired use some constructions may only use 1 line of slits on each face.

Figure 4:
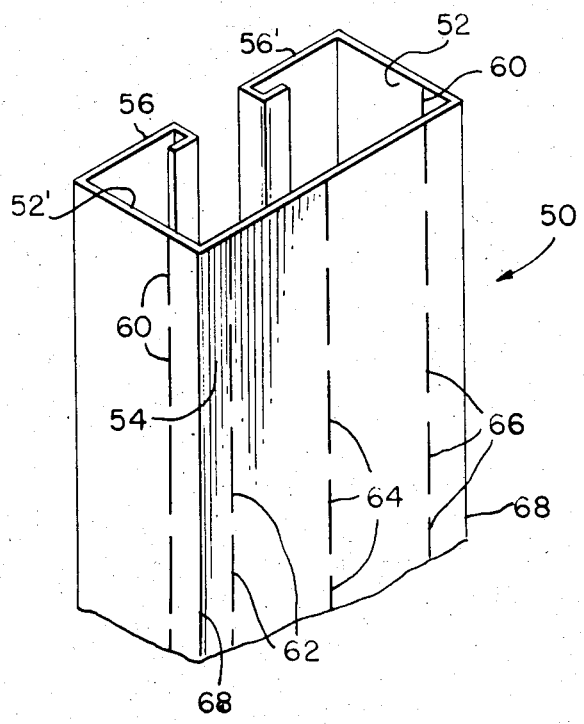
FIG. 4 is a fragmentary, perspective view of a c-beam contructed in accordance with the teachings of the present invention.

It will be recognized by those skilled in the art that where the metallic studs are used for interior walls having drywall on either end face the drywall sheathing acts as diaphragm for the reception and transmission of sound. By placing the slits in the stud as disclosed herein there is a substantial reduction in sound transmission. Referring now to FIG. 4 there is shown a c-shaped stud in transverse crossection generally designated 50 formed of 20 gauge plus or minus 8 gauge steel through heavier and lighter gauges may used. The stud 50 has end walls 52 and 52' and side wall 54, and two non-contiguous or non-joining side walls 56 and 56'. While this beam does lack some of the obvious structural advantages of a hollow-quadrangular beam of the box form of the invention. In this form of the invention wall 52 and 52' are only provided with a single line of interrupted slits 60 ⅓ the width of the walls from the corner contiguous with wall 54. Wall 54 may be provided with two or three slit lines designated 62, 64 and 66. Slit lines 62 and 66 are necessary whereas slit line 64 is optional. Further slit lines 62 and 66 as in the other form of the invention are ⅓ the wall 54 width from corners 68.

The invention slows the path of heat or sound transmission as herein before set forth. Considering only a single slit line having 80% slit and 20% solid the loss in transmission capability of the web is essentially 80% loss thus only 20% of the transmission of the wall remains. Adding a second line cuts 80% of the 20% transmission then by arithmetic only 20% of 20% is transmitted which is 4% of the total non-slitted wall transmission. Where a third line of slits is employed on the above web then only 20% of 4% transmission is possible which is 0.8% of the original 100%. Therefore, 99.2% has then stopped and three lines thus in the web is maximum as more lines do more to weaken the stud then is recovered in heat or sound economy.

Having described my invention, what is claimed is:

1. A structural metallic member particularly useful for forming interior and exterior wall, floor and ceiling support means of building structures consisting of a hollow, generally quadrangular in transverse crossection stud consisting of at least three contiguous walls comprising a pair of end walls and middle wall connecting the pair of end walls at a pair of corners, each of said walls having lengths and widths such as to form the structural member, the middle of the at least three walls being provided with a multiplicity of parallel, spaced, longitudinal rows of longitudinally spaced slits and each of the pair of end walls of the three walls being provided with a row of longitudinally spaced slits spaced about ⅓ the width of the end walls adjacent the corner contiguous with the middle wall said slits having a width of about 15,000 ths. of an inch to thereby reduce transmission of heat and sound there across and prevent convection of air currents therethrough.

2. The invention defined in claim 1, wherein the stud is configured as a C-beam.

3. The invention defined in claim 1, wherein the stud is configured as a box beam.

4. The invention defined in claim 3, wherein the stud is initially configured as a sheet of metal and thereafter folded.

5. The invention defined in claim 1 wherein the device is formed from a sheet of metal and then folded into a quadrangular configuration and fastened along the mating edges thereof.

* * * * *